US005934594A

United States Patent [19]

David

[11] Patent Number: 5,934,594

[45] Date of Patent: Aug. 10, 1999

[54] COILER IN WIRE ROLLING TRAINS

[75] Inventor: Siegfried David, Hilchenbach, Germany

[73] Assignee: SMS Schloemann-Siemag Aktiengesellschaft, Dusseldorf, Germany

[21] Appl. No.: 09/052,421

[22] Filed: Mar. 31, 1998

[30] Foreign Application Priority Data

Apr. 2, 1997 [DE] Germany ..... 197 13 603

[51] Int. Cl.[6] ..... B21C 47/10

[52] U.S. Cl. ..... 242/361; 242/361.4

[58] Field of Search ..... 242/361, 361.2, 242/361.4; 72/66, 135

[56] References Cited

U.S. PATENT DOCUMENTS

| | | | |
|---|---|---|---|
| 3,039,715 | 6/1962 | Caperton | 242/361.4 |
| 3,780,963 | 12/1973 | Hirschfelder | 242/361.2 |
| 4,242,892 | 1/1981 | Wykes et al. | 242/361 |
| 4,255,917 | 3/1981 | Stone | 242/361 |
| 4,765,556 | 8/1988 | Nasrah | 242/361 |
| 5,312,065 | 5/1994 | Shore et al. | 242/361 |

FOREIGN PATENT DOCUMENTS

| | | | |
|---|---|---|---|
| 5-92869 | 4/1993 | Japan | 242/361.4 |
| 943474 | 12/1963 | United Kingdom | 242/361.4 |

*Primary Examiner*—John P. Darling
*Attorney, Agent, or Firm*—Friedrich Kueffner

[57] ABSTRACT

A coiler in wire rolling trains includes a laying pipe support supporting a laying pipe, wherein the laying pipe support includes a support disk holding the wire insertion pipe member. The support disk is coupled for rotation with a rotating insertion sleeve for this pipe member, wherein the insertion sleeve supplies the wire, and wherein the support disk is connected coaxially with a cantilever projection which receives the laying arm portion of the laying pipe. The coiler includes a cylindrical or truncated cone-shaped surrounding body extending around the laying pipe support at a radial distance, wherein an end opening facing the insertion sleeve is releasably and attachably connected to the support disk of the laying pipe support, and wherein air passage openings are arranged in the wall of the surrounding body.

8 Claims, 2 Drawing Sheets

COILER IN WIRE ROLLING TRAINS

BACKGROUND OF THE INVENTION

1. Field of the Invention

The present invention relates to a coiler in wire rolling trains. The coiler includes a laying pipe support supporting a laying pipe, wherein the laying pipe support includes a support disk holding the wire insertion pipe member. The support disk is coupled for rotation with a rotating insertion sleeve for this pipe member, wherein the insertion sleeve supplies the wire, and wherein the support disk is connected coaxially with a cantilever projection which receives the laying arm portion of the laying pipe.

2. Description of the Related Art

For protection against external influences and for preventing accidents, coilers of this type are provided with a stationary, removable box-like protective hood which surrounds the moveable parts of the coiler. Because of the quickly rotating parts of the support elements of the laying pipe and of the pipe itself, strong air turbulences occur within this protective hood, frequently resulting also in vibrations of the entire unit and increasing the energy requirement for the drive of the coiler.

SUMMARY OF THE INVENTION

Therefore, it is the primary object of the present invention to improve the above-described configuration of coilers in such a way that the air turbulences are significantly reduced, the resulting vibrations are eliminated and, thus, also the energy requirement for the drive of the coiler is reduced.

In accordance with the present invention, the coiler includes a cylindrical or truncated cone-shaped surrounding body extending around the laying pipe support at a radial distance, wherein an end opening facing the insertion sleeve is releasably and attachably connected to the support disk of the laying pipe support, and wherein air passage openings are arranged in the wall of the surrounding body.

In accordance with another feature of the present invention, the surrounding body includes an annular disk provided with passage openings for the laying arm and with air passage openings, wherein the annular disk is releasably and attachably placed in the end opening facing away from the insertion sleeve. In accordance with another feature, air guiding elements of the turbine-disk type may be placed in the air passage openings. In the event the surrounding body is of a truncated cone-shaped configuration, the portion of the surrounding body receiving the annular disk may have the shape of a cylindrical attachment.

In accordance with another feature of the present invention, the free end face of the cantilever projection may have a longitudinal center opening for the insertion of the lifting arm of an assembly lifting unit, wherein the lifting arm, constructed as a U-shaped arm member, may have two or more points of engagement for the lifting unit, wherein the points of engagement are offset relative to each other.

Aside from the improvements already mentioned above, the coiler equipped with the above-discussed features of the present invention provides the advantages that, by means of the air passage openings in the surrounding body and the annular disk and the air guiding elements in the surrounding body, a controlled air flow can be produced by appropriately cooling the laying pipe and the support elements, and the laying pipe and its support elements can be moved by means of the U-shaped arm member and the offset points of engagement for the lifting unit into the horizontal pipe exchange position as well as into the inclined position of operation.

Finally, in accordance with a further development of the present invention, outside of the wire rolling train may be arranged a rotatably mounted insertion element corresponding to the insertion sleeve and a support carriage receiving the surrounding body and the support elements of the laying pipe, wherein, after insertion of the wire insertion pipe portion into the insertion element, coupling the support disk to the latter and separating the connection between the support disk and the end opening of the surrounding body, the support carriage can travel over the insertion element and, thus, can make it possible that the support elements of the laying pipe and the laying pipe itself supported by the insertion element are freely accessible from the outside.

This configuration makes it possible to move support elements of the laying pipe together with the surrounding body out of the wire rolling train and to exchange them for a prepared set of support elements and laying pipe, for example, for reducing the length of interruptions of the operation of the train. After pushing away the surrounding body, the laying pipe of the removed set can be subjected to maintenance work or can be also exchanged, for example, for a laying pipe having a shape more favorable to other operating conditions. This exchange is significantly simplified as a result of the free accessibility of the laying pipe, for example, when the pipe is clamped by tensioning means. Furthermore, the support elements of the laying pipe can be balanced without difficulties by means of a stationary balancing machine.

Because of the improved cooling of the laying arm and its support elements, the simple balancing possibility, the elimination of vibrations, the better adjustment of the laying pipe shape to the respective operating conditions and the short periods of interruptions of operation, the use of the present invention also results in the production of more uniform wire windings, correspondingly more uniform placement of the windings and, thus, better wire coil shapes. In addition, the generation of noise is reduced and the service life of the laying pipes is increased.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
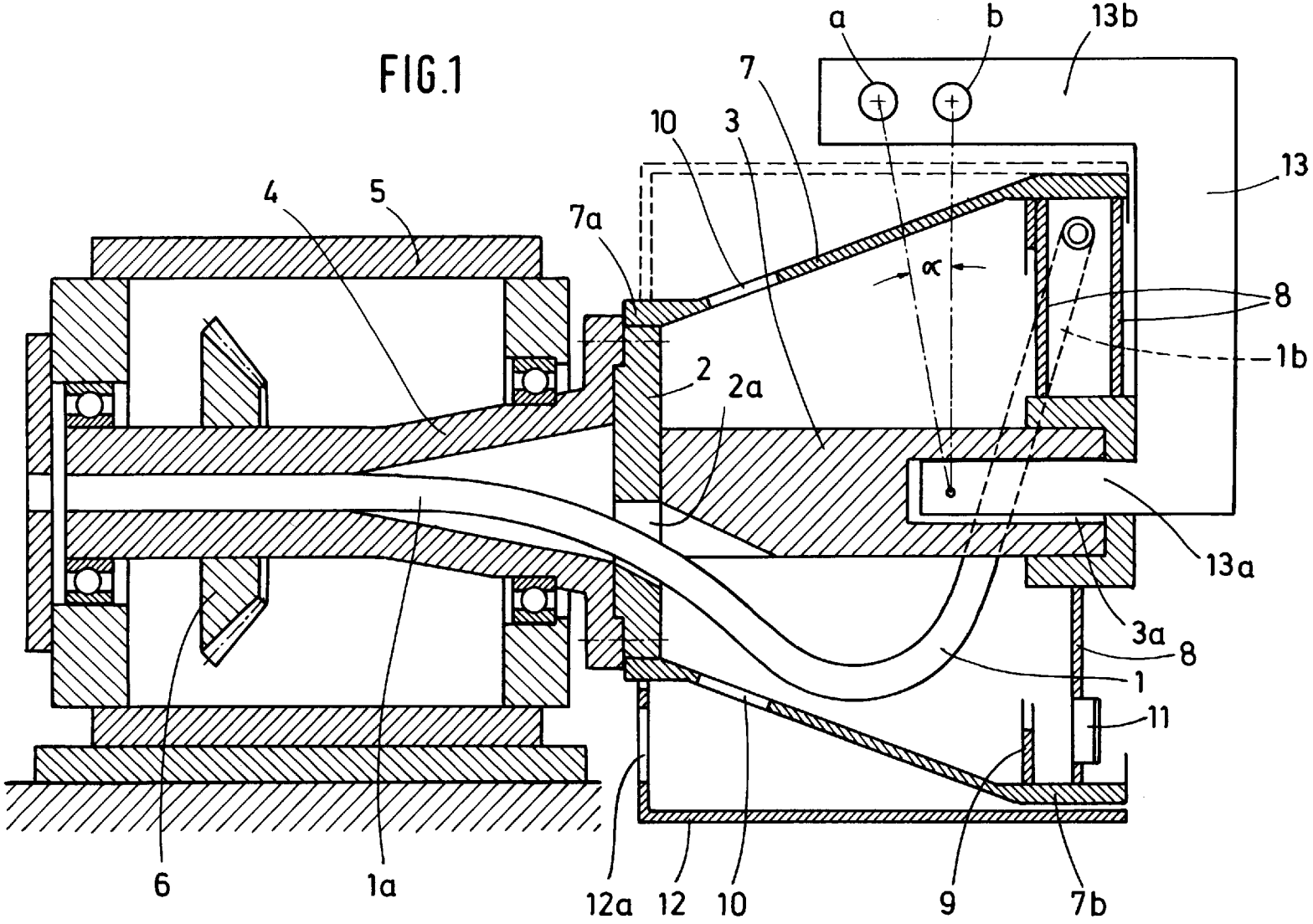
FIG. 1 is a schematic side view, partially in section, showing the coiler according to the present invention.

As illustrated in FIG. 1 of the drawing, the coiler is arranged at the exit of a wire rolling train, not shown. The coiler includes a laying pipe 1, which is supported by a support disk 2 and a cantilever projection 3 connected coaxially to the support disk 2. The wire insertion pipe portion 1*a* of the laying pipe 1 extends through a cutout 2*a* in the support disk 2 and is inserted with its insertion into an insertion sleeve 4 which is supported in a drive housing 5 and is driven, in a manner not illustrated, by a bevel gear 6.

The support disk, the cantilever projection 3 and the wire insertion pipe member 1*a*, as well as the laying arm pipe portion 1*b* held by the support elements 8 placed on the end of the cantilever projection, are surrounded by a surrounding body 7 which, in the illustrated embodiment, is constructed in a truncated cone-shape. The smaller opening of the truncated cone-shaped surrounding body 7 facing the insertion sleeve 4 ends in a flange ring 7*a* which is slid onto the support disk 2 and is releasably connected to the support disk 2 in a manner which is not illustrated. The larger opening of the surrounding body 7 facing away from the insertion sleeve 4 ends in a cylindrical projection 7*b* into which an annular plate 9 is inserted. The wall of the surrounding body 7 has air passage openings 10; the support elements 8 also have air passage openings, wherein the support elements 8 are additionally provided with air guide elements 11 in the form of turbine disks.

When the insertion sleeve 4 causes rotation of the support disk 2 with cantilever projection 3, of the support elements 8 and of the laying pipe 1 supported by the support elements 8 and surrounded by the surrounding body 7 with the annular plate 9, the guide elements 11 produce by an air intake through the air passage openings 10 an air flow flowing through the surrounding body 7 and emerging at the cylindrical attachment 7*b*. This air flow acts particularly on the laying pipe 1 and the support elements 3 and 8 thereof. The surrounding body 7 is in turn surrounded by a safety hood 12 which, in the illustrated embodiment, also has air passage openings 12*a*.

An arm 13*a* of a U-shaped lifting arm 13 can be inserted into a longitudinal center opening 3*a* at an end face, wherein the other arm 13*b* is provided with two points of engagement a and b for a lifting unit, not shown, wherein the points of engagement a and b are offset relative to each other. These offset points of engagement a and b make it possible to move the cantilever projection 3 and, thus, the laying pipe optionally into a horizontal laying pipe exchange position or an operating position which is inclined by the angle $\alpha$ relative the vertical.

Figure 2:
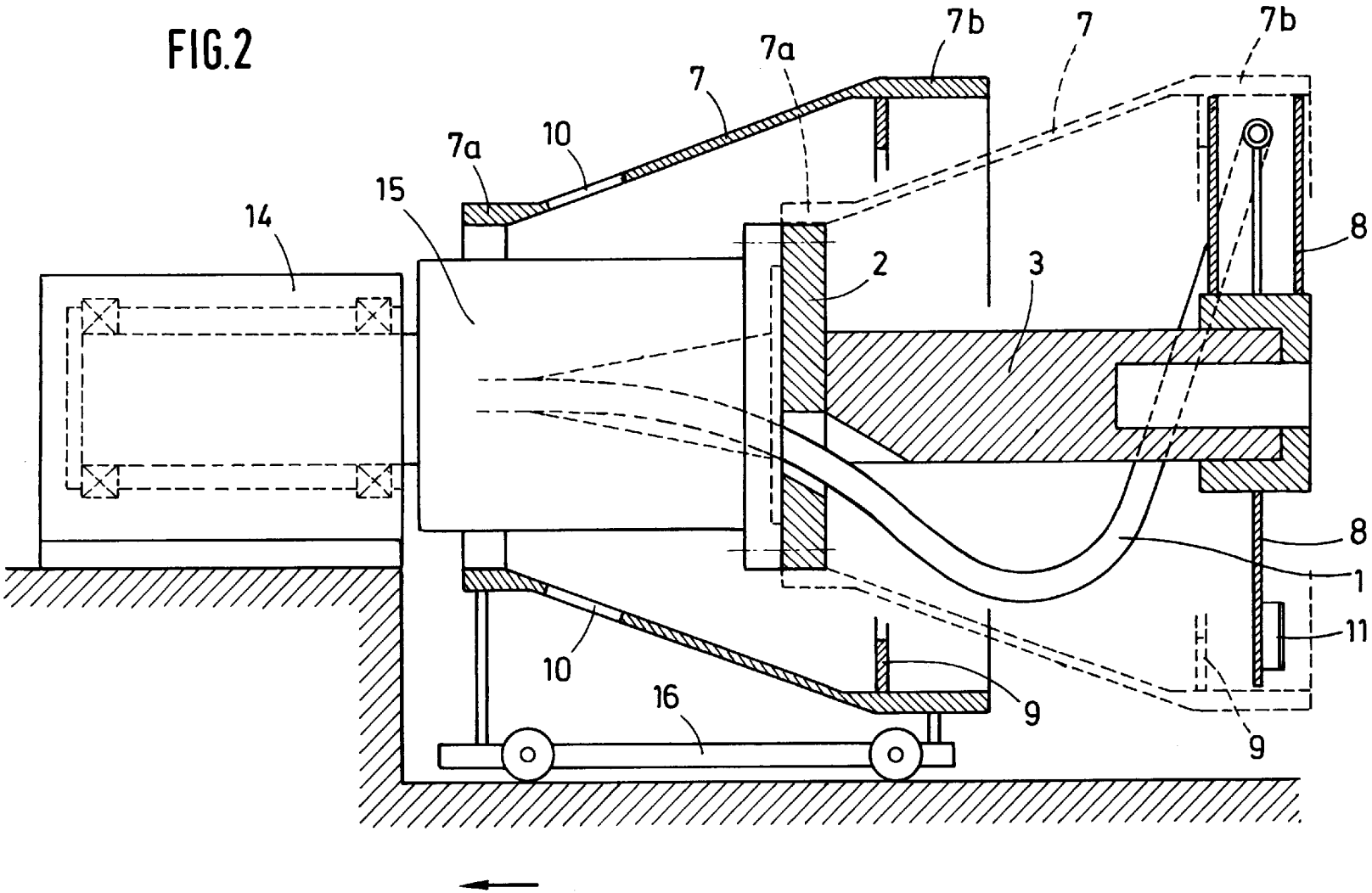
FIG. 2 is a side view, partially in section, of the coiler of FIG. 1 shown in a different position of operation.

FIG. 2 of the drawing shows an insertion element 15 which corresponds to the insertion sleeve 4 according to FIG. 1 and is arranged outside of the wire rolling train and is mounted in a stationary bearing housing 14. Coupled to this insertion element 15 is the support disk 2 of the coiler which, in accordance with the configuration of FIG. 1, is composed of this support disk 2, the cantilever projection 3, the laying pipe 1 and its support elements as well as the surrounding body 7. After separating the connection between the flange ring 7*a* and the support disk 2, the support carriage 16 is pushed in the direction of the arrow shown in FIG. 2 and thereby moves the surrounding body 7 with the smaller opening over the insertion element 15 from the position shown in broken lines into the position shown in solid lines. As a result, the support disk 2 with the cantilever projection 3 and the laying pipe 1 with the support elements 8 become freely accessible for any intended or necessary exchange and maintenance operations.

The invention is not limited by the embodiments described above which are presented as examples only but can be modified in various ways within the scope of protection defined by the appended patent claims.

I claim:

1. A coiler in wire rolling trains, the coiler comprising a laying pipe and a laying pipe support for supporting the laying pipe, the laying pipe support comprising a support disk for holding a wire insertion pipe member, a rotatable insertion sleeve for the wire insertion pipe member for supplying wire, means for coupling for rotation the insertion sleeve and the support disk, a cantilever projection for receiving a laying arm portion of the laying pipe connected concentrically to the support disk, further comprising a surrounding body having a body wall and extending around the laying pipe support at a radial distance, the surrounding body having a first end opening facing the insertion sleeve, the first end opening being releasably and attachably connected to the support disk of the laying pipe support, wherein the body wall has air passage openings.

2. The coiler according to claim 1, wherein the surrounding body is truncated cone-shaped.

3. The coiler according to claim 1, wherein the surrounding body has a second end opening facing away from the insertion sleeve, further comprising support elements of the laying arm portion inserted in the second end opening, the support elements having air passage openings.

4. The coiler according to claim 3, further comprising air guide elements in the form of turbine disks placed in the air passage openings of the support elements.

5. The coiler according to claim 3, wherein the surrounding body is truncated cone-shaped, and wherein a wall portion of the surrounding body with the support elements has the shape of a cylindrical attachment.

6. The coiler according to claim 1, wherein the cantilever projection has a free end face, the free end face having a longitudinal center opening adapted for insertion of a lift arm of an assembly lifting unit.

7. The coiler according to claim 6, wherein the lift arm is an arm of a U-shaped lifting member, the lift arm having two or more points of engagement for the the assembly lifting unit, wherein the points of engagement are offset relative to each other.

8. A coiler in wire rolling trains, the coiler comprising a laying pipe and a laying pipe support for supporting the laying pipe, the laying pipe support comprising a support disk for holding a wire insertion pipe member, a rotatable insertion element for the wire insertion pipe member for supplying wire, means for coupling for rotation the insertion element and the support disk, a cantilever projection for receiving a laying arm portion of the laying pipe connected concentrically to the support disk, further comprising a surrounding body having a body wall and extending around the laying pipe support at a radial distance, the surrounding body having a first end opening facing the insertion element, the first end opening being releasably and attachably connected to the support disk of the laying pipe support, wherein the body wall has air passage openings, wherein the insertion element is mounted outside of the wire rolling train, further comprising a support carriage for supporting the surrounding body and support elements for the laying pipe, wherein the support carriage is configured such that, after placing the wire insertion pipe member into the insertion element, coupling the support disk to the insertion element and separating the connection between the support disk and the end opening of the surrounding body, and when the support carriage is moved over the insertion element, the support elements of the laying pipe supported by the insertion element and the laying pipe itself are freely accessible.

* * * * *